US007088054B2

(12) United States Patent
Erlbacher et al.

(10) Patent No.: US 7,088,054 B2
(45) Date of Patent: Aug. 8, 2006

(54) APPARATUS FOR EMITTING PULSES OF LIGHT AND SYSTEMS EMPLOYING SUCH APPARATUS

(75) Inventors: Andreas Erlbacher, Abtenau (AT); Wolfgang Fuchs, Salzburg (AT); Lutz Niggl, Salzburg (AT)

(73) Assignee: Tecan Trading AG, Mannedorf (CH)

( * ) Notice: Subject to any disclaimer, the term of this patent is extended or adjusted under 35 U.S.C. 154(b) by 33 days.

(21) Appl. No.: 10/833,226

(22) Filed: Apr. 27, 2004

(65) Prior Publication Data

US 2004/0263090 A1 Dec. 30, 2004

(30) Foreign Application Priority Data

May 5, 2003 (CH) ..... 0790/03

(51) Int. Cl.
*H05B 41/30* (2006.01)

(52) U.S. Cl. ..... 315/200 A; 315/200 CD

(58) Field of Classification Search ..... 315/241 P, 315/241 S, 241 R, 273, 351, 349, 209 CD, 315/209 A, 219; 250/458.1; 356/317, 318
See application file for complete search history.

(56) References Cited

U.S. PATENT DOCUMENTS

| | | | | |
|---|---|---|---|---|
| 3,655,818 | A | 4/1972 | McKown | 428/118 |
| 4,748,382 | A * | 5/1988 | Walker | 315/241 P |
| 5,039,219 | A * | 8/1991 | James et al. | 356/318 |
| 5,602,446 | A | 2/1997 | Kolber et al. | 315/241 P |
| 6,011,359 | A * | 1/2000 | Days | 315/241 S |
| 6,856,241 | B1 * | 2/2005 | Tice et al. | 340/331 |

FOREIGN PATENT DOCUMENTS

GB 2 007 047 5/1979

* cited by examiner

*Primary Examiner*—Trinh Vinh
*Assistant Examiner*—Ephrem Alemu
(74) *Attorney, Agent, or Firm*—Notaro & Michalos PC

(57) ABSTRACT

An apparatus with a flash lamp can trigger a flash of light by application of an ignition pulse. The apparatus encompasses a first capacitor, a second capacitor, a switching element and a control circuit. The first capacitor, second capacitor and switching element are arranged in a network in such a way that the switching element is located on the low side of a power circuit. The apparatus can be operated in a first mode and a second mode by actuating the control circuit. In the first mode the first capacitor is discharged by the flash lamp, triggering a flash of light of high energy. In the second mode the second capacitor is discharged by the flash lamp and a flash of light of low energy is triggered.

12 Claims, 4 Drawing Sheets

APPARATUS FOR EMITTING PULSES OF LIGHT AND SYSTEMS EMPLOYING SUCH APPARATUS

The invention relates to an apparatus for emitting pulses of light and systems with such apparatus. In particular, it relates to the invention of a filter-based or monochromator-based fluorometer, photometer and other measurement or laboratory devices with such apparatus.

The priority of Swiss patent application 2003 0790/03 filed on May 5, 2003 is being claimed.

Flash lamps generally have a maximum flash energy and a maximum average light output which they can discharge, without being damaged or destroyed.

There are numerous applications requiring the emission of the maximum possible flash energy with such a flash lamp. If the flash energy is repeatedly discharged too frequently, the maximum output of the lamp will be exceeded and the lamp destroyed. The main problem with these applications is the dissipation of heat.

This is primarily a problem with systems which can be operated in high-speed mode, whereby several flashes are triggered in a short period of time.

On the other hand, there are other applications which do not rely on a high repetition rate, but only on the discharge of the maximum possible flash energy.

There are circuits, whereby the high voltage at the flash lamp is controlled in order to regulate flash generation. However, as a rule high voltage can only be controlled within a limited range. Furthermore, complex circuitry is required as special precautions need to be undertaken in high voltage applications. One apparatus which governs the discharge of flash lamps is described in U.S. Pat. No. 6,157,144, to mention only one of numerous documents describing the state of the art. This US patent also describes a method for governing the charging of a capacitor.

An apparatus is known from a completely different field of application, which is designed to emit flashes of light of differing intensity. This apparatus is described in U.S. Pat. No. 3,792,309 and is designed specifically to be employed in landing field approach lighting system applications at airports. Provision is made for a plurality of capacitors which emit a discharge current for triggering a flash in a flash lamp. In accordance with this US patent it is possible to switch the circuit, thereby switching from the emission of a flash at a first repetition rate to the emission of a flash at a higher repetition rate. Subject to requirements, further capacitors can be connected in parallel. This connection is achieved by means of relays. Similar circuits (10 and 20) are shown diagrammatically in FIGS. 1 and 2 as block diagrams.

The circuits 10 and 20 encompass flash lamps 11, 21, and in each case a network with two capacitors C1, C2. Depending upon the circuit, provision is made for switches S1, or S2, respectively, to discharge one or the other capacitor.

U.S. Pat. No. 5,602,446 makes known a flash control unit with a high repetition rate, making provision for a circuit for generating an ignition pulse and a network with two capacitors in series, which serves to trigger an arc discharge in a flash lamp. The capacitors are connected to the flash lamp by means of a current switch. In order for the current switch to be able to switch the extremely high currents flowing in the large current sections of the flash control unit, provision is made for a special current switch, embodying five IGBTs in parallel, whereby each is capable of switching approximately 250 A.

An electronic discharge module is known, which can be used to emit pulses of light by means of a solid-state laser. Such a discharge module is described in the publication "Electronic discharge module for pump systems of solid state lasers", V. V. Togatov et al., J. Opt. Technol, Vol. 67, No. 4, April 2000, pp. 379–382. This discharge module is designed especially for a solid-state laser.

A further flash lamp control device is made known in GB patent 2 007 047. This patent describes a charge circuit with a change over switch designed to govern whether only a first capacitor is charged or the first capacitor and a second capacitor are charged together.

Further examples can be found in U.S. Pat. Nos. 3,644,818 and 5,602,446.

The known circuits have various disadvantages which are particularly disadvantageous when a flash lamp with its corresponding control system is required in a setting in which the claims are important with respect to reproducibility, stability and temperature behavior.

Furthermore, the state of the art does not provide any instruction on how a flash lamp can be controlled in different ways, without resulting in overheating.

There are laboratory, medical and other applications employing flashes of light for the purpose of measurement. In such settings it is vital that each emission of a flash complies with clearly defined specifications. Furthermore, some applications require that highly sensitive measurements can be made, thus demanding high intensity pulses of light, while others require measurements to be made with low intensity light pulses, for instance to protect sensitive materials such as cells or dyes.

Therefore, there is a need for an apparatus which can emit high intensity light pulses and low intensity light pulses, whereby high demands are placed upon reproducibility, accuracy, stability and temperature behavior.

The object of the invention is to provide for a system, for instance a measurement device, which can emit high intensity pulses of light and low intensity pulses of light.

These requirements are fulfilled in accordance with the invention by means of an apparatus which comprises a flash lamp capable of triggering a flash of light by applying an ignition pulse, a first capacitor, a second capacitor, at least one switching element, a control circuit, and an active charge controller for charging the first capacitor and/or the second capacitor. The first capacitor, the second capacitor and the switching element are arranged in a network in such a manner that the switching element is located in the small current section of the apparatus and the apparatus can be operated as required in either a first or a second mode by actuating the control circuit in a first mode and a second mode. In the first mode at least the first capacitor is discharged by applying the ignition pulse to the flash lamp, triggering a flash of light of higher energy. The first mode is a high sensitivity mode where the flashes of light are emitted at a lower repetition rate. In the second mode the second capacitor is discharged by applying the ignition pulse to the flash lamp, triggering a flash of light of lower energy. This second mode is a high speed mode where the flashes of light are emitted at a high repetition rate.

These requirements are fulfilled in accordance with the invention by means of a system with an apparatus for emitting flashes of light, as addressed above, an apparatus for receiving or holding a sample, and a detector. The apparatus for emitting the flashes of light, the receiving or holding apparatus, and the detector are arranged in such a manner that the flashes of light sweep over, illuminate or penetrate the sample and that the detector receives at least a portion of the flashes of light emitted by the sample or the light transmitted by the sample and provides it for analysis.

Various advantageous embodiment are addressed in the respective dependent claims.

The following schematic drawings are intended to clarify the preferred embodiments of the apparatus in accordance with the invention and the system in accordance with the invention, without restricting the scope of the invention in any way.

DETAILED DESCRIPTION

Figure 1:
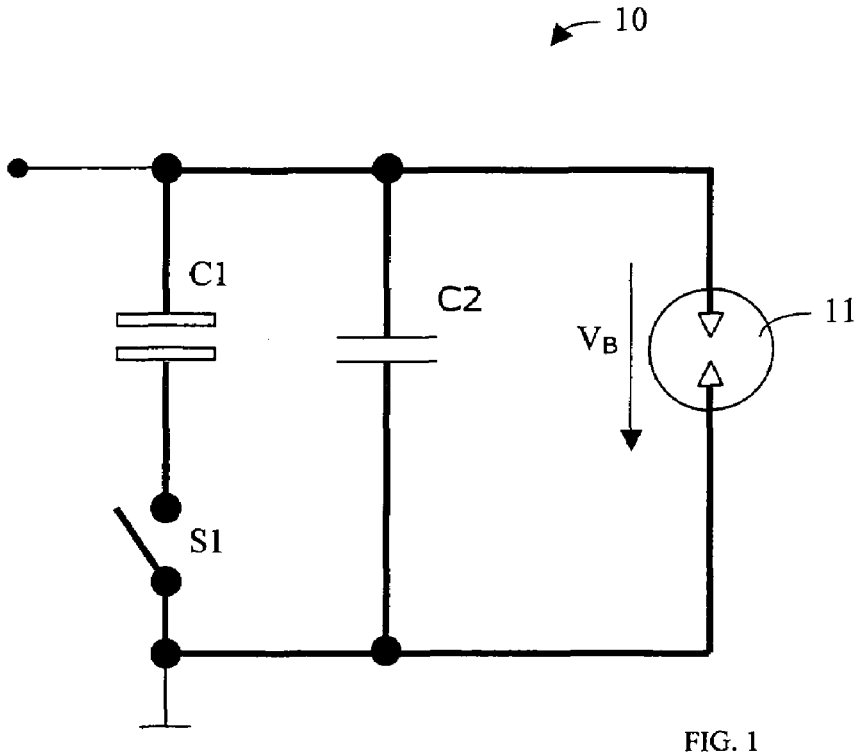
FIG. 1 shows a block diagram of a first conventional flash control unit.
Figure 2:
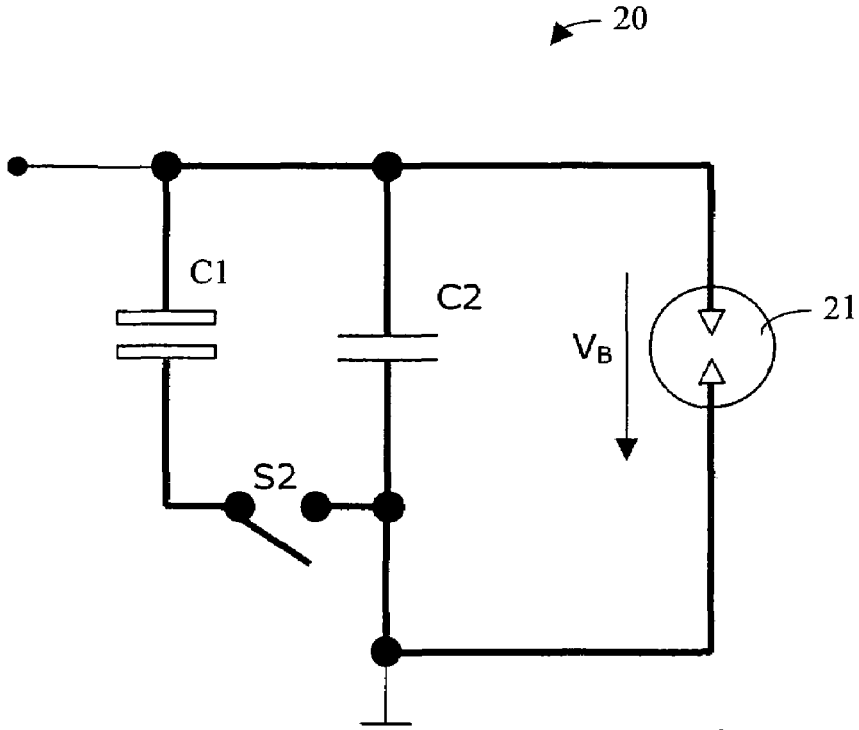
FIG. 2 shows a block diagram of a second conventional flash control unit.
Figure 3:
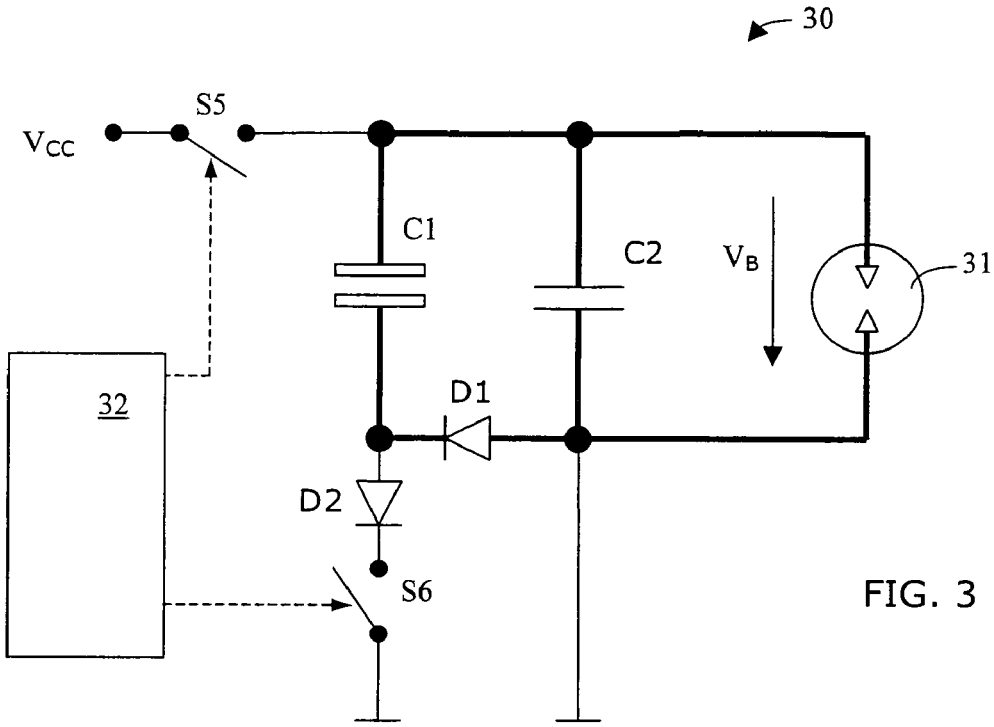
FIG. 3 shows a block diagram of a first flash control unit in accordance with invention.

The block diagram of a first apparatus in accordance with the invention 30 is shown in FIG. 3. The apparatus 30 encompasses a flash lamp 31 whereby a flash of light can be triggered by means of an ignition pulse. The apparatus 30 provides for a network with a capacitor C1, a capacitor C2 and a switching element S6. In addition, provision is made for a control circuit 32, which is only represented diagrammatically in FIG. 3.

The capacitor C1, the capacitor C2 and the switching element S6 are arranged in the network in such a way that the apparatus 30 can be operated in a first mode and in a second mode by actuating the control circuit 32.

In accordance with invention, in order to emit a flash of light of higher energy E3 in the first mode (with the switching element S6 closed), the capacitor C1 and the capacitor C2 are charged and the flash lamp 31 can be triggered by applying the ignition pulse. The energy E3 is proportional to the total charge Q3 for the capacitors C1 and C2 switched in parallel. In the second mode (with the switching element S6 open) only the capacitor C2 is charged and the flash lamp 31 emits a flash of light with lower energy E2 when the ignition pulse is applied. The energy E2 is proportional to the charge Q2 of the capacitor C2.

It should be noted that the large current sections of the circuits in the figures are indicated by thick connecting lines, while the small current section is indicated by thinner lines.

The capacitors C1 and C2 in parallel, or the capacitor C2 by itself can be selectively charged by setting the position of the switching element S6. The apparatus 30 can be isolated from the supply voltage $V_{cc}$ by means of the switching element S5. Instead of applying a fixed supply voltage $V_{cc}$ to the apparatus, the capacitors can be charged by feeding in charge packets (see the embodiment shown in the FIGS. 5A, 5B). If S5 and S6 are closed, the capacitors C1 and C2 can be charged together. In this case this results in an effective capacitance $C_e$=C1+C2, as C1 and C2 are switched in parallel. If the switching element S5 is closed and the switching element S6 is open, only the capacitor C2 is charged. In this embodiment the capacitor C2 is also charged every time. The capacitor C1 is only added when there is a need to emit a flash of higher energy E3. The diode D2 prevents the discharge current from flowing via the switching element S6. In other words, the switching element S6 is located in the small current section of the circuit.

If a sufficient (minimum) voltage $V_B$ is applied across the two electrodes of the flash lamp 31, the flash lamp 31 is triggered autonomously, or it can be triggered by means of an ignition pulse.

The apparatus 30 shown allows one to switch back and forth between the first and the second mode. If required, a flash of higher energy E3 can be emitted. In another situation, a flash or several flashes of lower energy E2 can be emitted.

The charging current for charging the capacitors C1, C2 flows via the closed switching element S5. If the capacitors C1, C2 are charged by means of charge packets, the charge packets flow via the switching element S5. The entire discharge current does not flow via the switching element S6, as said element is located in the small current section.

Figure 4:
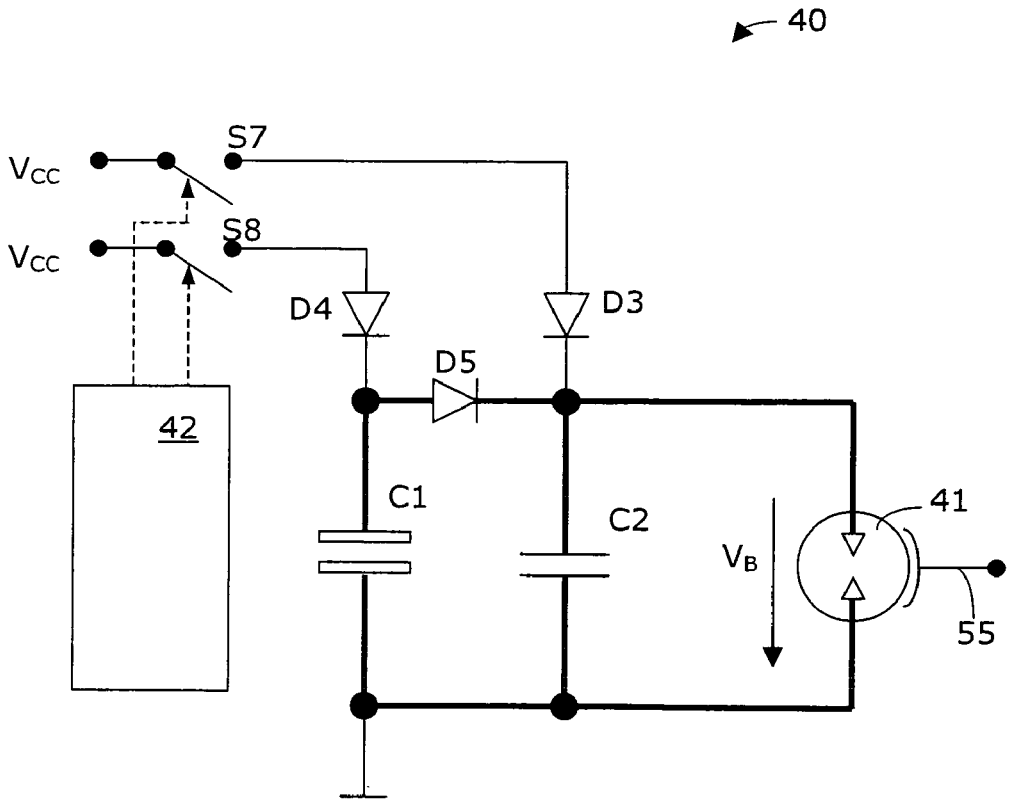
FIG. 4 shows a block diagram of a second flash control unit in accordance with invention.

The block diagram of a second apparatus 40 in accordance with the invention is shown in FIG. 4. The apparatus 40 once again encompasses a flash lamp 41, which can be triggered to emit a flash of light by means of an ignition pulse. The flash lamp 41 is provided with a special connector 55 for applying an ignition pulse, as indicated diagrammatically in FIG. 4. The apparatus 40 provides for a network with a capacitor C1, a capacitor C2 and switching elements S7 and S8. In addition, provision is also made for diodes D3, D4 and D5. Furthermore, there is a control circuit 42 which is only indicated diagrammatically in FIG. 4. The capacitor C1, the capacitor C2, the diodes D3, D4 and D5 and the switching elements S7, S8 are arranged in the network in such a way that the apparatus 40 can be operated by means of the control circuit 42 in a first mode and in a second mode.

In accordance with the invention the capacitor C1 and the capacitor C2 are charged in the first mode with the switching element S8 closed and the flash lamp 41 can be triggered to emit a flash of light of high energy E3 by applying the ignition pulse. The energy E3 is proportional to a total charge Q3 of the capacitors C1 and C2 switched in parallel. In the second mode, with switching element S8 open and switching element S7 closed, only the capacitor C2 is charged and the flash lamp 41 emits a flash of light of low energy E2 when an ignition pulse is applied. The energy E2 is proportional to the charge Q2 of the capacitor C2.

Both the circuits 30 and 40 can be modified in various ways, while noting the fact that the switching element, which determines the selection of the first or of the second mode of operation, is always located in the small current section of the circuit. The circuit 40 shown in FIG. 4 can for instance be modified by dispensing with the switching element S7. In this case the capacitor C2 is always charged. If the switching element S8 is closed, the two capacitors C1 and C2 are charged.

In accordance with the invention the following switching elements can be used: switches (e.g. with digital trigger input), relays, transistors, thyristors, IGBTs (insulated gate bipolar transistors), or comparable. When making selection and dimension decisions, the fact must be considered that the switching element is arranged only in the small current section and is not arranged on the discharge side (large current section), as is the case in the state of the art.

In one embodiment, the flash lamp can be capable of emitting a flash of light which is triggered by applying an ignition pulse to a connector for which special provision has been made (e.g. connector 55 in FIG. 4). There are flash lamps, whereby the discharge path (sometimes known as pre-ignition) is ionized by applying the ignition pulse to this special connector. This ionization then results in the actual flash discharge, whereby a electric arc is produced between the two flash lamp electrodes. Other flash lamps have no such special connector, but are triggered by applying an appropriate voltage (also known as an ignition pulse in this situation) to the two electrodes.

The following flash (discharge) lamps or lamps of similar design are especially suitable:

Xenon flash lamps, e.g. XE-2000 or FX1161 Xenon flash lamp;

Halogen flash lamp; a halogen flash lamp can be used for instance for the visible and the near-infrared range;

mercury flash lamps.

Flash lamps can be used which are either integrated directly or are installed in the circuit in accordance with the invention. Alternatively, lamps can be used which are connected by means of a plug (for example a trigger socket FYD1150) or another connection. As a rule, not only the voltage $V_B$ is then fed via the pins on this plug, but also the ignition pulse.

It is also conceivable for several flash lamps to be arranged in parallel in order to increase the luminous efficacy. Consequently, the apparatus in accordance with the invention must then be dimensioned more robustly.

Figure 5A:
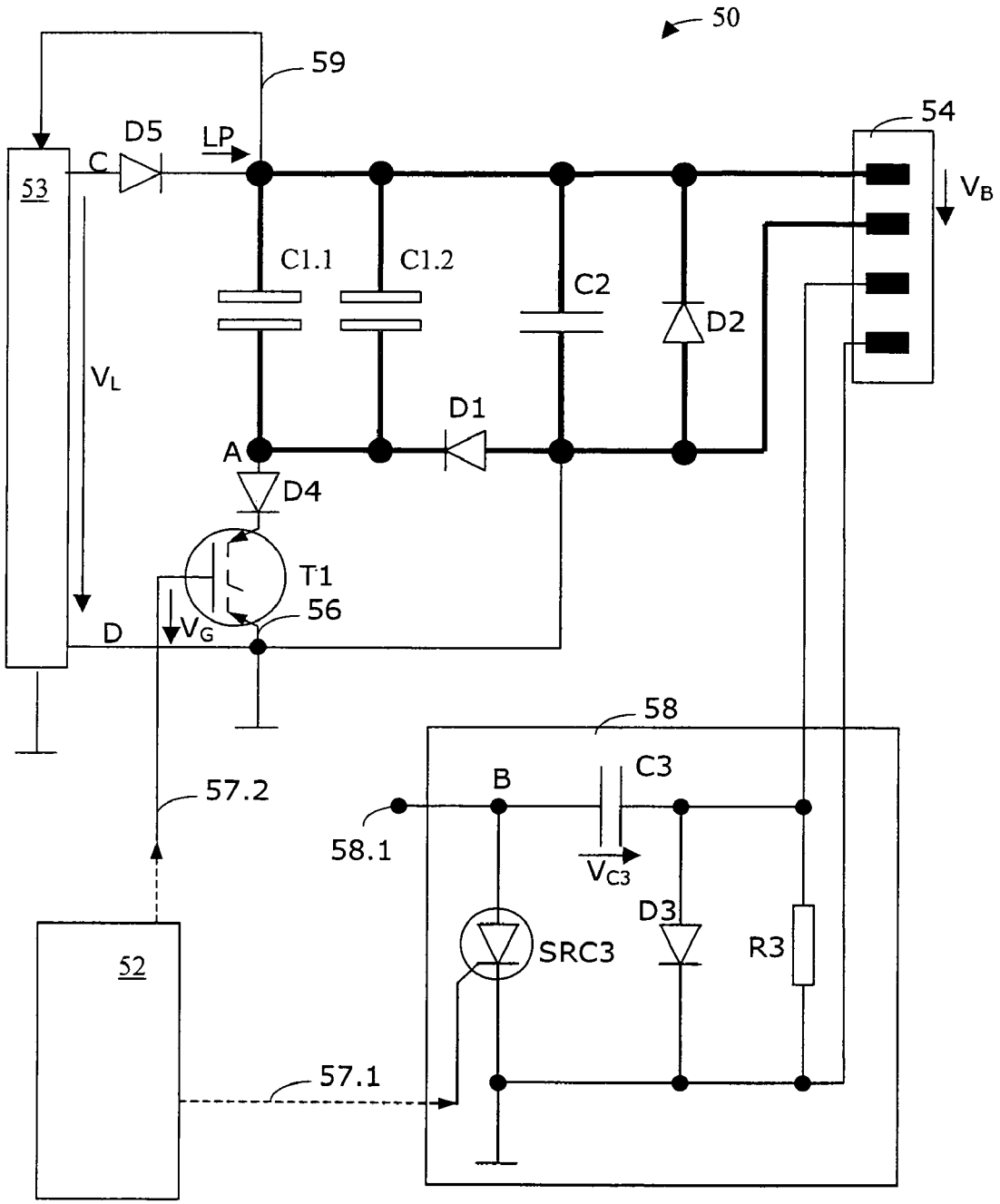
FIG. 5A shows a block diagram of a third flash control unit in accordance with invention.
Figure 5B:
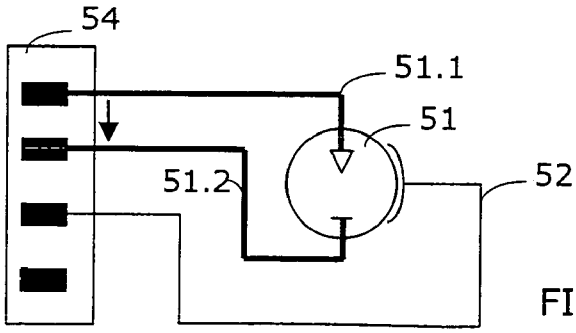
FIG. 5B shows a flash lamp connected to a plug in accordance with FIG. 5A

FIG. 5A shows a detailed block diagram of another apparatus 50 in accordance with the invention. The apparatus 50 is of a similar design to the apparatus 30 shown in FIG. 3. The flash lamp 51 is shown in FIG. 5B. The flash lamp 51 is connected to the apparatus 50 by means of a plug 54. The upper two pins of the plug 54 apply the voltage $V_B$ to the two electrodes (anode 51.1, cathode 51.2) of the flash lamp 51. The two lower pins of the plug 54 provide the flash lamp 51 with the ignition pulse.

The apparatus 50 makes provision for a network with a capacitor C1, which encompasses two switched capacitors C1.1 and C1.2 in parallel in order to obtain a sufficiently large capacitance. Furthermore, provision is made for a capacitor C2 and a switching element T1. The apparatus 50 in the embodiment shown has four diodes: D1, D2, D4 and D5. The capacitors C1.1 and C1.2, the capacitor C2, the diodes D1 and D2 and the switching element T1 are arranged in the network in such a way that the apparatus 50 can be operated in a first mode and in a second mode by actuating a control circuit 52. The control circuit 52 is only indicated diagrammatically in FIG. 5. It controls the switching element T1 via a wire 57.2. The switching element T1 shown in the circuit is an IGBT. As is the case with a MOSFET transistor, the IGBT T1 governs the switching state by means of the gate voltage $V_G$. If the gate voltage $V_G$ at the gate 57.2 is lower than the threshold voltage $V_{th}$ in relation to the emitter, then no inversion layer is generated and the switching element T1 is switched off. This means that point A in the network is not grounded and the electrodes of the capacitors C1.1, C1.2 are on the same potential. This means that the capacitors C1.1, C1.2 will not be charged. On the other hand, the capacitor C2 is being charged. If the control circuit 52 increases the gate voltage $V_G$ SO that it exceeds the threshold voltage $V_{th}$, the switching element T1 switches through and grounds point A or modifies the potential to a level roughly equating to ground potential. In this state the capacitors C1.1, C1.2 and C2 are being charged together, as the diode D1 allows the current to flow.

It is important that the gate voltage $V_G$ of the IGBT T1 is always several volts above the voltage at the connection 56. Overall, the network in FIG. 5 is designed in such a way that the switching element T1 is located in the small current section and the discharge current does not flow via the switching element T1 when the flashes of light are emitted.

The apparatus 50 encompasses a control circuit 52 which affects the state of the switching element T1, allowing one to control whether the apparatus 50 is operated in a first or second mode.

In the embodiment shown the control circuit 52 also controls the emission of an ignition pulse via a connection 57.1. An exemplary circuit 58 is shown which is suitable for triggering such an ignition pulse via the two pins of the connector 54. The circuit 58 encompasses a thyristor SRC3, a capacitor C3, a diode D3 and a resistor R3 switched in parallel. This circuit 58 functions in the following manner. When the control circuit 52 emits a short pulse to the thyristor SRC3 via the connection 57.1, the point B is briefly grounded. If the capacitor C3 was previously charged, there is now a voltage $V_{C3}$ across the capacitor C3, as shown in FIG. 5. This voltage $V_{C3}$ is emitted as a short voltage pulse to the flash lamp 51 via the two lower pins of the connector 54. The capacitor C3 then recharges itself until a new short pulse is supplied to the thyristor SRC3. The flash lamp 51 is not triggered directly by the short voltage pulse to the lower pins of the connector 54, but a corresponding circuit is located in the socket of the flash lamp 51. In the case of the embodiment shown, this circuit generates the required ignition pulse.

In another embodiment the circuit 58 can be designed in such a manner that this circuit provides the ignition pulse directly.

In the example shown, the apparatus 50 also encompasses a charge controller 53, which detects the present voltage at the capacitors C1.1 and C1.2 in order to charge these capacitors gradually with charge packets until a set voltage is reached. The present voltage is tapped for instance via a connection 59 and fed to the charge controller 53. The charge controller 53 feeds the voltage packets $V_L$ between the points C and D in the network and charges the capacitors gradually. The charge controller 53 preferably has an integrated circuit which not only measures the present voltage, but also provides the charge pulses in the form of voltage packets $V_L$. A controller chip can be employed for instance as an integrated circuit which serves to regulate the current. The charge controller 53 can have a transformer for this purpose in order to generate the voltage packets $V_L$ of sufficient amplitude from the low voltage. This type of charge controller 53 is also known as an active charge controller.

It is preferable to use an active charge controller of this type in conjunction with the circuits shown in FIGS. 3 and 4 as well.

The circuit 58 can also have a transformer, which steps up the voltage in order to provide the ignition pulse. Such a transformer can for instance be arranged on the input side 58.1. In this way the voltage for charging the capacitor C3 is provided via the transformer.

In a further embodiment the capacitor C3 is charged by means of charge packets, analogously to the charging process for the capacitors C1.1, C1.2 and C2. The control circuit 52 can have for instance an integrated circuit which not only measures the present voltage, but also provides the charge pulses in the form of voltage packets. A controller chip can be used as an integrated circuit for instance, which serves to control the current. The control circuit 52 can have a transformer for this purpose in order to generate voltage packets with sufficient amplitude from a low voltage.

In accordance with the invention, the apparatus 30, 40 and 50 are characterized by the fact that they can be operated as required in either the first or the second mode. The second mode is preferably a high-speed mode, whereby flashes of light can be emitted at a high repetition rate. These flashes of light have relatively little energy E2. In the first mode, also known as high-sensitivity mode, flashes of light with high energy E1 or E3 can be emitted, but at a slower repetition rate. Therefore, the apparatus in accordance with the invention is especially suited for applications in special measurement devices which rely on accuracy and reproducibility.

Figure 6:
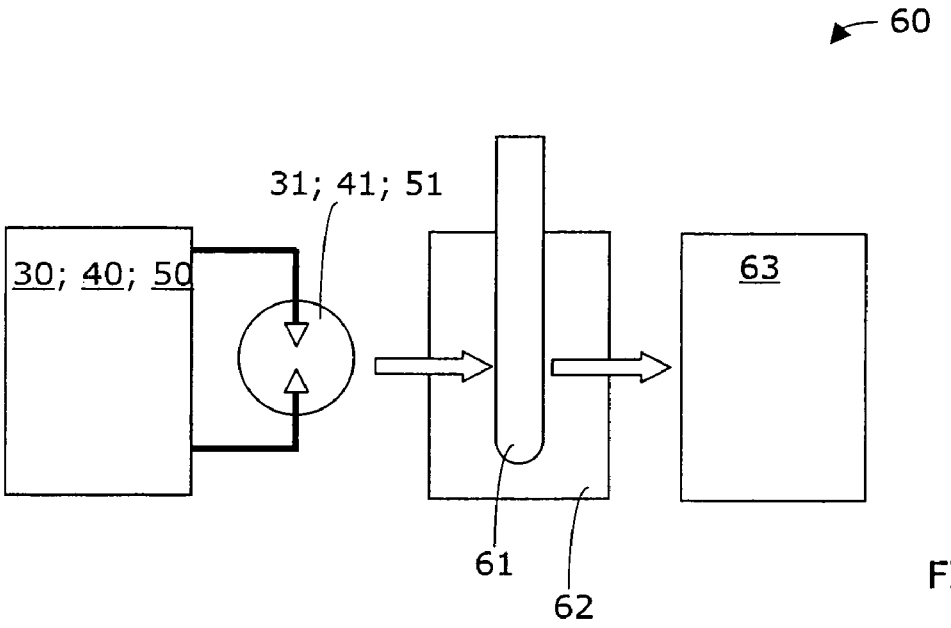
FIG. 6 shows a block diagram of another embodiment in accordance with invention.
Figure 7:
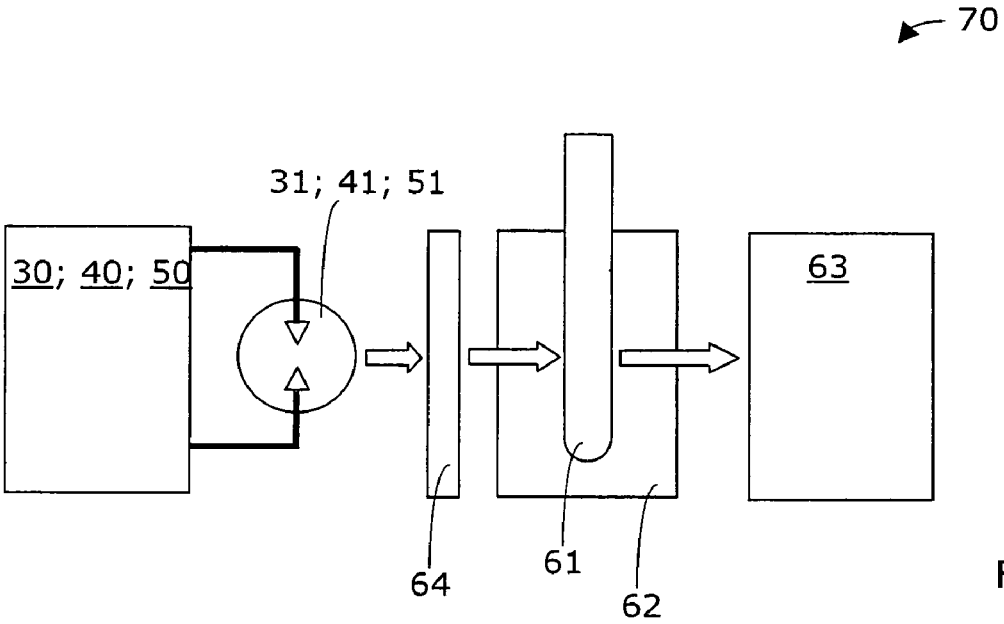
FIG. 7 shows a block diagram of yet another embodiment in accordance with invention.

The invention is especially suitable for use in filter or monochromator 64 based fluorometers 70 or photometers 60 which emit flashes in high-speed mode and in high sensitivity mode, with only a single flash lamp being used (see FIG. 6 or 7). The apparatus 30, 40, or 50 in accordance with the invention is then used as a light source 31, 44, 51 which directs flashes of light over an optical path into a substance/sample 61 being measured or analyzed. Emitted light, reflected light, or light which has passed through the substance, is then recorded and analyzed by means of sensors 63, e.g. in the form of a photomultiplier. It is important in the case of such systems that only a single flash lamp be used, in order to ensure that the geometric arrangement for the two modes of operation is unchanged.

The monochromator 64 can have a titer plate or similar with numerous substance receptacles 62, for instance in the form of wells, which can be exposed to flashes of light from a flash lamp one after the other in sequence. In order to increase the throughput of such a monochromator 64, it is important that the device be operated in high-speed mode, without the flash lamp being destroyed as a result of overheating.

A microplate scanner with a monochromator, such as for instance the Safire™ system produced by TECAN, can encompass an apparatus in accordance with the invention. In this way one has a flexible system for measuring absorption and for fluorescence applications, such as for instance measuring the intensity of fluorescence or for time resolved fluorescence measurement.

If for instance biological substances or sensitive dyes are being analyzed, it is also preferable to use the high speed mode as the substances are exposed to lower amounts of flash energy.

In high sensitivity mode one can increase the energy in the flash for instance to penetrate more dense substances or to generate more fluorescent light by increasing the excitation energy, thereby increasing the sensitivity of the measurement device.

The apparatus in accordance with the invention can also be employed for instance for spectrometer applications and for other optical applications.

The invention can be used as well for instance to great benefit in Forensics. The apparatus in accordance with the invention can be used also for example in a forensic analysis device which determines the composition of fluids in a test tube by means of high energy light pulses (excitation light).

In a further embodiment provision is made for a processor, for instance a microprocessor, which controls one or several of the following processes:

switching between the first and the second mode
triggering an ignition pulse
monitoring a process or several measurement processes
switching a device on and off The corresponding process control data can be stored in a non-volatile memory.

In another embodiment the apparatus in accordance with the invention or the corresponding system can be connected by means of an interface with an external processor. The external processor can be located for instance in a computer.

An advantage of the invention is that the flash lamp can be operated in a work setting which allows one to employ the desired features of the lamp without destroying it.

Another advantage of the invention is that the voltage between the electrodes of the flash lamp remains unchanged. This ensures greater accuracy and reproducibility of measurements. The invention differs in this essential point, among others, from flash circuits which control the intensity of the flash emitted by altering the voltage at the flash lamp.

What is claimed is:

1. An apparatus with a flash lamp capable of triggering a flash of light by applying an ignition pulse,
a first capacitor,
a second capacitor,
at least one switching element,
a control circuit, and
an active charge controller for charging the first capacitor and/or the second capacitor,
whereby the first capacitor, the second capacitor and the switching element are arranged in a network in such a manner that the switching element is located in the small current section of the apparatus and the apparatus is operated as required in either a first or a second mode by actuating the control circuit, whereby
in the first mode at least the first capacitor is discharged by applying the ignition pulse to the flash lamp, triggering a flash of light of higher energy, said first mode being a high sensitivity mode where the flashes of light are emitted at a lower repetition rate,
in the second mode the second capacitor is discharged by applying the ignition pulse to the flash lamp, triggering a flash of light of lower energy, said second mode being a high speed mode where the flashes of light are emitted at a high repetition rate.

2. The apparatus in accordance with claim 1, wherein the network is designed in such a way that prior to discharging either the first capacitor, or
the second capacitor, or
the first capacitor and the second capacitor is/are charged by the active charge controller.

3. The apparatus in accordance with claim 1, wherein during discharging no discharge current flows through the switching element.

4. The apparatus in accordance with claim 1, wherein the first capacitor has a capacitance which is greater or equal to the capacitance of the second capacitor.

5. The apparatus in accordance with claim 1, wherein the network encompasses a diode which is arranged in such a way that in the second mode the second capacitor is isolated from the first capacitor by the diode.

6. The apparatus in accordance with claim 1, wherein the control circuit encompasses a means for generating the ignition pulse or for triggering the generation of the ignition pulse.

7. The apparatus in accordance with claim 1, wherein the flash lamp has a trigger connection for applying or impressing the ignition pulse.

8. The apparatus in accordance with claim 1, wherein the apparatus is operated in the first mode or in the second mode as a function of the control circuit setting.

9. The apparatus in accordance with claim 8, wherein the switching element has an input for triggering a switch from one mode to another mode.

10. The apparatus in accordance with claim 9, wherein the active charge controller detects the present voltage at the first capacitor and/or the second capacitor in order to gradually charge the first capacitor and/or the second capacitor with charge packets until a specified voltage is reached.

11. A system with an apparatus for emitting flashes of light in accordance with claim 1, an apparatus for receiving or holding a sample, and a detector, whereby the apparatus for emitting the flashes of light, the receiving or holding apparatus, and the detector are arranged in such a manner that the flashes of light sweep over, illuminate or penetrate the sample and that the detector receives at least a portion of the flashes of light emitted by the sample or the light transmitted by the sample and provides it for analysis.

12. The system in accordance with claim 11 wherein the system encompasses one or two monochromators, whereby the light emitted by the flash lamp and/or the sample is filtered spectrally by the one or two monochromators.

* * * * *